US005882428A

United States Patent [19]

Gawne

[11] Patent Number: 5,882,428

[45] Date of Patent: Mar. 16, 1999

[54] METHOD OF FLUSHING A CIRCULATION SYSTEM USING FIRST AND SECOND RIGS

[75] Inventor: Lawrence A. Gawne, Wixom, Mich.

[73] Assignee: Graco Inc, Minneapolis, Minn.

[21] Appl. No.: 925,973

[22] Filed: Sep. 9, 1997

[51] Int. Cl.[6] ..... B08B 9/02; B08B 9/04

[52] U.S. Cl. ..... 134/8; 134/22.11; 134/38

[58] Field of Search ..... 134/8, 22.11, 22.12, 134/38

[56] References Cited

U.S. PATENT DOCUMENTS

| | | | |
|---|---|---|---|
| 3,562,014 | 2/1971 | Childers et al. | 134/22.11 |
| 4,416,703 | 11/1983 | Scott | 134/8 |
| 5,192,595 | 3/1993 | Akeel et al. | 134/22.11 |
| 5,632,822 | 5/1997 | Knipe, Jr. et al. | 134/22.12 |

*Primary Examiner*—Lyle A. Alexander
*Assistant Examiner*—Saeed Chaudhry
*Attorney, Agent, or Firm*—Douglas B. Farrow

[57] ABSTRACT

This cleaning system is designed to automated and minimize or eliminate the excessive amount of manpower associated with other suction processes. It is a combination of paint recovery, and flushing methods in a automated manner. It is designed to minimize the paint lost as a result of color changing of circulation systems, as well as minimize the associated time and solvents used to in the cleaning process. This is accomplished by inserting a first pig into the circ system at the end of a desired painting cycle to push out the paint and propelling the first pig through the system using a solvent. The location of the first pig is then sensed and the first pig collected from the system. A second pig is injected into the system to separate the solvent from a new cycle of paint.

1 Claim, 3 Drawing Sheets

METHOD OF FLUSHING A CIRCULATION SYSTEM USING FIRST AND SECOND RIGS

BACKGROUND OF THE INVENTION

The use of pigs for cleaning piping is not new. Graco Europe has used round ball pigs for years for pipe cleaning and Complete Automation has installed 2 or more pigable systems in the USA. BMW has a pigable system that was written up in the April issue of *Industrial Paint and Powder*. However, none of these systems are automated.

SUMMARY OF THE INVENTION

This cleaning system is designed to automated and minimize or eliminate the excessive amount of manpower associated with other suction processes. It is a combination of paint recovery, and flushing methods in a automated manner. It is designed to minimize the paint lost as a result of color changing of circulation systems, as well as minimize the associated time and solvents used to in the cleaning process.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIGS. 1–3 are schematic representations of the instant invention.

DESCRIPTION OF THE PREFERRED EMBODIMENT

Figure 1:
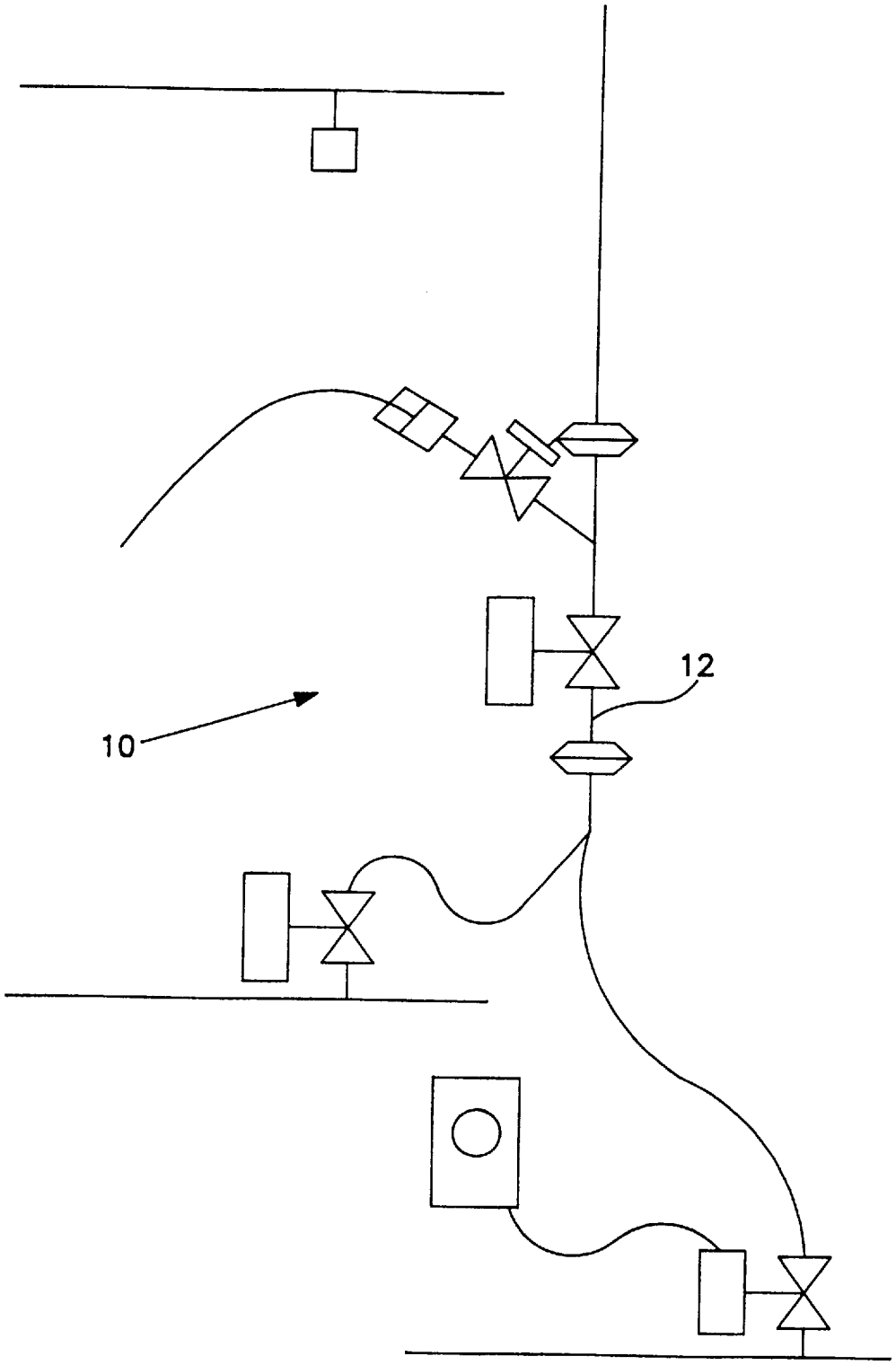
Figure 2:
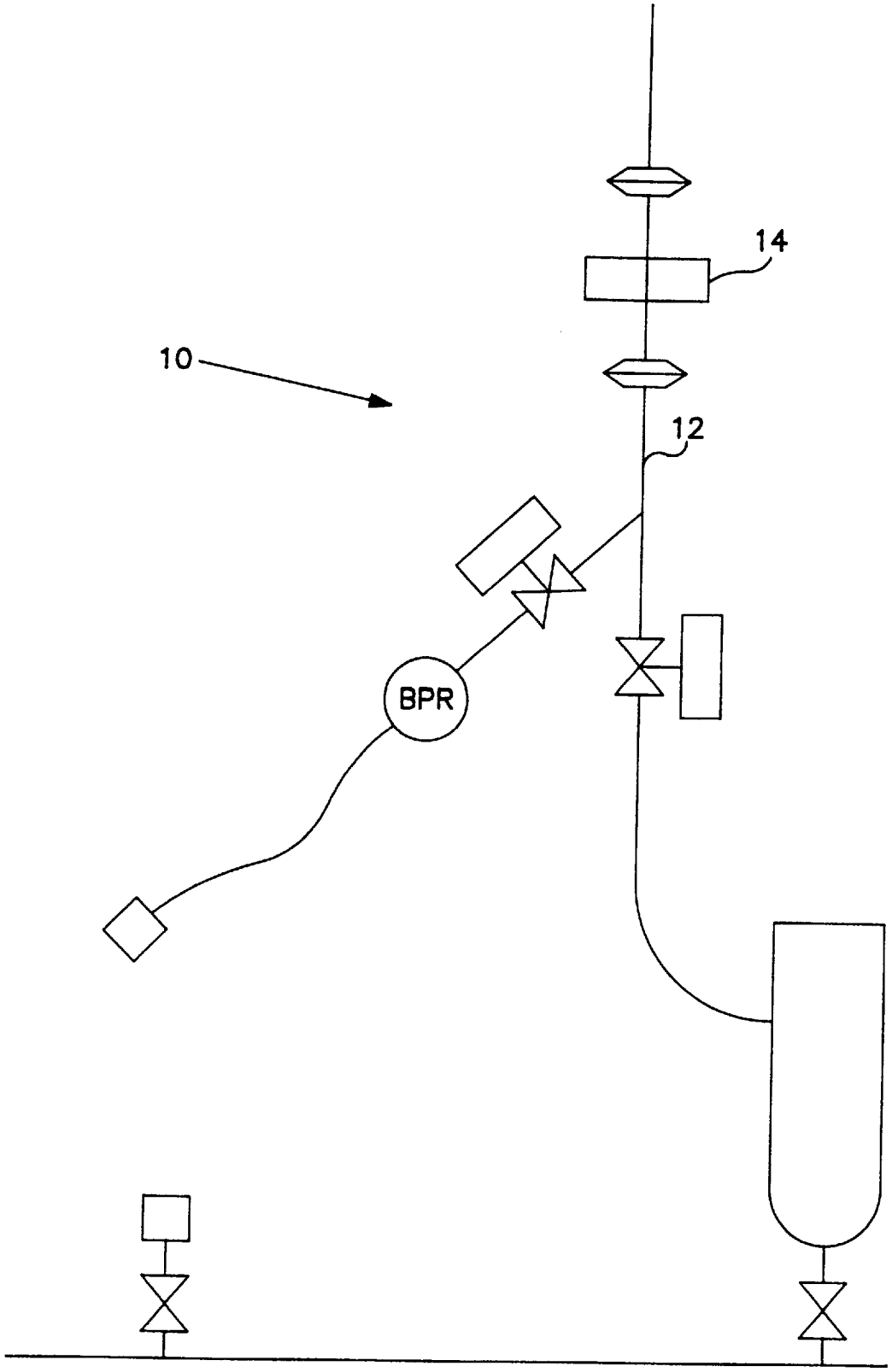
Figure 3:
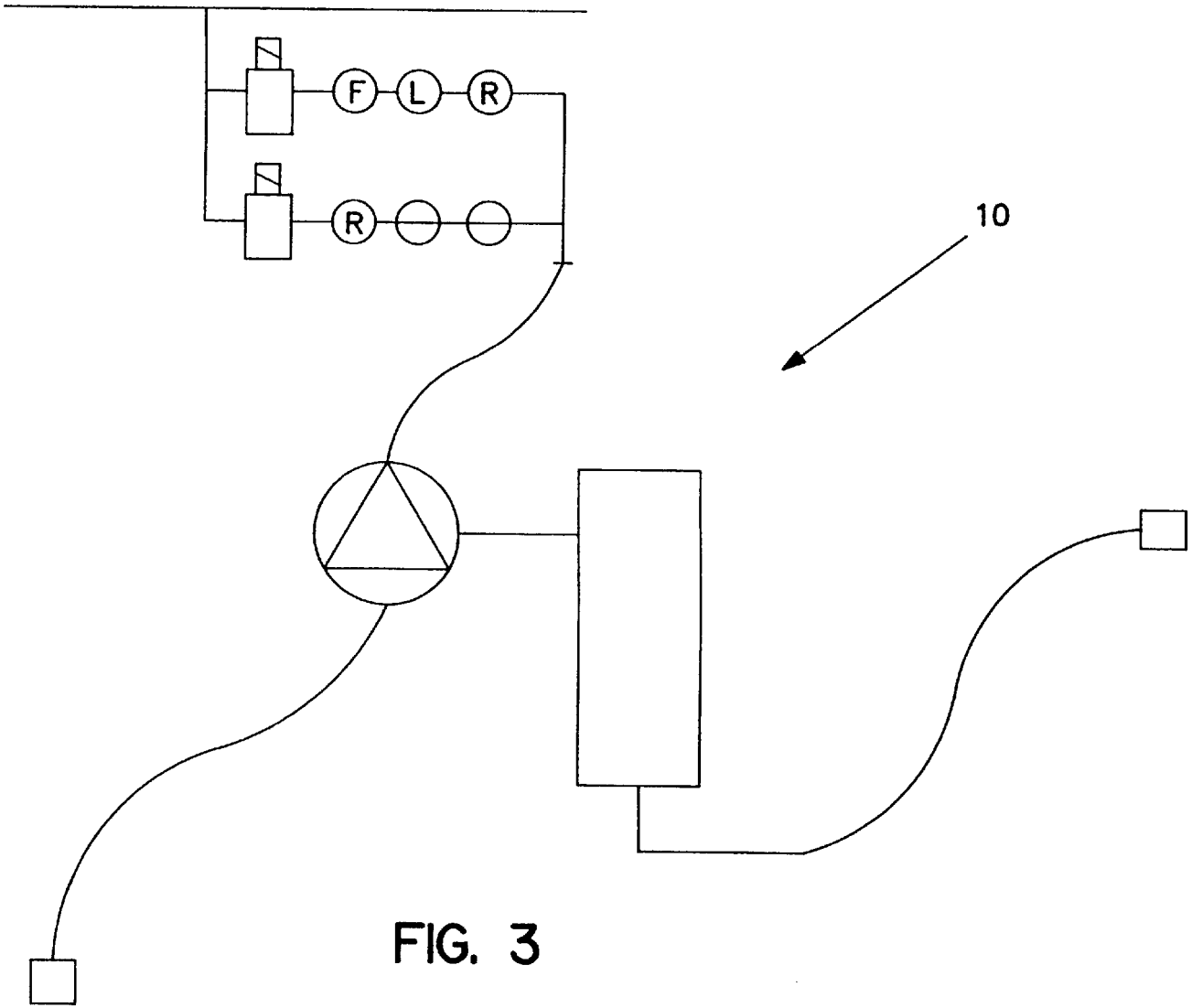

Construction and Operation-The cleaning process begins with the removal of the existing paint from the system 10. One of the ways this can be accomplished is through the use of a pipe pig 12. This pig will be inserted into the pipe line during normal production without interruption. At the appropriate time the pig will be automatically injected into the piping and begin to push the paint contained in the piping back to the container from which it originated or any other alternate source. The pig may be propelled through the system by a cleaning material which may be either air, solvent, water, or any other compressible or non-compressible gas or liquid.

A key element in this design is a pig positioning sensor 14 that will determine when the pig has passed any given point in the system and allow addition functions to occur automatically. For this example the sensor will be located in the mix room just prior to a series of automatic valves that direct the returning paints and flushing solvents. As the pig enters this sensing area the automatic valve directing paint to the return tank will be closed, and a waste line collection automatic valve will be opened. The waste line collection valve will allow the pig to continue to travel into a "multi-pig collection vessel". The vessel is connected to a central waste collection pipe system. Once the pig is collected in the collector, the compressed air or solvent used to propel the pig is directed to the central waste collection system.

Based on the system size and design, a series of automatically timed or metered functions will provide and direct the flushing of the pump and system. This will include the flushing of paint drops, and related piping.

Upon completion of the flushing of the system a new pig will be inserted into the system and pushed through the piping by the next "new color" to be loaded into the system. The pig will function as a isolation block to prevent the paint from becoming saturated with the remaining solvent in the line and creating additional waste. As the pig enters the mix room pig sensing station, the pig will be directed to the "multi-pig collection vessel" and then the automatic valve closed and the paint directed to the paint return line completing the loading of the new color.

Additional controls will provide for a timed or metered flushing of the paint circulation pump and related components to first capture the paint in these devises, and secondly minimize the solvent usage.

The pig propulsion and system flushing will be a central system. The Graco Turbo-Flush system or other air/solvent system can be used to minimize both the flushing time and solvent usage.

OPERATION OF THE INVENTION

Color Change Required

1. Before completion of painting process, operator loads pig in "pig holding tube" and connects air/Turbo-Flush hose with sanitary clamp Painting process completed, begin Flush Program 1. Operator places selector switch in "Purge" mode.

Pump Flushing

1. Operator disconnects pump suction Q.D. from paint supply and connect to solvent supply header.
2. Operator initiates paint pushout of paint remaining in pump, filter, and associated hoses into main piping. When completed the operator interface panel indicates completed.
3. Operator next disconnects pump fluid Q.D. from supply piping and connects to mix room waste solvent collection header.
4. Operator initiates pump flush program by pushing "Pump Flush" push button. Controls perform a programmed pump flush cycle.

Paint Reclaim and Piping Flush

1. Operator initiates first stage paint reclaim by pushing "First Stage Purge" push button on panel which opens flush ball valve and starts pig moving through the piping system. This pig pushing maybe with a straight air push or Turbo-Flush solvent/air push. Paint is pushed back through BPR to original container.
2. When pig passes the "pig sensor" on return pipe, the BPR automatic ball valve to paint return is closed and automatic ball valve to waste collection is opened allowing pig to travel to "multi-pig catcher" and solvent/air to vent to mix room waste collection. Pig pushing source is closed. System is de-pressurized and automatic valve to waste collection is closed.
3. Operator disconnects paint return hose Q.D. from supply container and connects to mix room waste collection header.
4. Operator initiates Turbo-Flush time program by pushing "Second Stage Purge" push button and piping is cleaned including BPR and paint return hose. Flush complete all automatic ball valves closed.
5. Operator load new loads new pig in "pig holding tube" and connects sanitary clamp assembly.
6. Operator initiates air push of pig to remove any remaining solvent from system by pushing "Third Stage Purge" push button. Solvent pushed into mix room waste collection header, pig retained in "multi-pig catcher".
7. Operator places selector switch in "Clean" mode, all valves remain closed.

Paint Load Program

1. Operator places selector switch in "Paint Load" mode.
2. Operator connects paint suction line Q.D. to new container of paint. Operator pushes "Pump Load" push button and pump is cycled through timer to push solvent in pump and filter into mix room waste collection header. Pump stops and operator connects pump supply hose QD. to system piping and places selector switch into "Paint" mode and pushes "Paint" push button. Pump is started and BPR automatic ball valve is opened. System now loaded with paint and ready for production.

It is contemplated that various changes and modifications may be made to the system without departing from the spirit and scope of the invention as defined by the following claims.

What is claimed is:

1. A method of flushing a paint circulation system comprising the steps of:

inserting a first pig into said system at the end of a desired painting cycle to push out said paint;

propelling said first pig through said system using a cleaning material;

sensing the location of said first pig in said system;

collecting said first pig from said system; and injecting a second pig into said system to separate said cleaning material from a new cycle of said paint.

* * * * *

UNITED STATES PATENT AND TRADEMARK OFFICE

CERTIFICATE OF CORRECTION

PATENT NO. : 5,882,428
INVENTOR(S) : Gawne, Lawrence A.
DATED : March 16, 1999

It is certified that error appears in the above-identified patent and that said Letters Patent is hereby corrected as shown below:

Title page, item [54] and col. 1, line 2, the Title should read – Pigs, not Rigs--.

Signed and Sealed this

Twenty-seventh Day of July, 1999

*Attest:*

Q. TODD DICKINSON

*Attesting Officer*

*Acting Commissioner of Patents and Trademarks*